United States Patent [19]

Carey

[11] Patent Number: 4,615,153

[45] Date of Patent: Oct. 7, 1986

[54] LEADER FILTER

[76] Inventor: Robert J. Carey, P.O. Box 158, Sea Bright, N.J. 07760

[21] Appl. No.: 786,760

[22] Filed: Oct. 11, 1985

[51] Int. Cl.[4] ..... E04D 13/06; E04D 13/08

[52] U.S. Cl. ..... 52/12; 52/16; 210/162; 405/119

[58] Field of Search ..... 52/12, 16; 210/162, 210/460; 405/119

[56] References Cited

U.S. PATENT DOCUMENTS

| | | | |
|---|---|---|---|
| 939,838 | 11/1909 | Hensler | 52/12 X |
| 2,533,402 | 12/1950 | Schmitz, Jr. | 52/12 X |
| 2,669,358 | 2/1954 | Young | 210/460 |
| 2,807,368 | 9/1957 | Blau | 52/12 X |
| 4,112,691 | 9/1978 | Ebeling et al. | 52/12 X |
| 4,404,775 | 9/1983 | Demartini | 52/12 |
| 4,411,110 | 10/1983 | Carey | 52/12 X |

FOREIGN PATENT DOCUMENTS

| | | | |
|---|---|---|---|
| 3139304 | 4/1983 | Fed. Rep. of Germany | 52/16 |
| 108927 | 8/1979 | Japan | 52/16 |

*Primary Examiner*—Alfred C. Perham

*Attorney, Agent, or Firm*—R. Gale Rhodes, Jr.

[57] ABSTRACT

Leader filter for being mounted at the top of a leader extending down the side of a building and below the discharge opening formed in the bottom of a rain gutter attached to the building adjacent the edge of a roof upon which rain falls, said leader filter for preventing entrance thereinto of leaves and other debris which cause leader clogging and the stoppage of rain flow through the leader, including a generally closed hollow leader filter including a top, two sides, a bottom, front and back, the sides are provided with a plurality of longitudinally extending, generally horizontally disposed rows of slots such that there is no generally vertical path of rain flow down said sides which is not interrupted by at least one of the slots, the slots are of a predetermined size sufficiently small to generally prevent the entrance thereinto and into the generally closed hollow leader filter of the leaves and other debris, the top is for receiving rain from the rain gutter discharge opening and for diverting the rain down the sides and the slots for receiving rain flowing across the sides and for diverting the rain into said hollow leader filter means, and the bottom is provided with a discharge opening for communicating with the leader and through which discharge opening rain flows from the leader filter into the leader; in one embodiment the slots are a plurality of longitudinally extending, generally horizontally disposed rows of interrupted slots, wherein the interruptions between the slots in each row are displaced horizontally with respect to the interruptions between the slots in the next adjacent row of slots; and in another embodiment the slots are a plurality of longitudinally extending, generally horizontally disposed rows of slots extending across the entire width of the sides.

19 Claims, 6 Drawing Figures

LEADER FILTER

BACKGROUND OF THE INVENTION

This invention relates to a new and improved generally closed, hollow leader filter for being mounted at the top of a leader or downspout and for preventing entrance into the leader of leaves and other debris which cause leader clogging and stoppage of rain flow through the leader.

As is known to those skilled in the art, and as is particularly well known to homeowners having trees in their yards close to their house, rain gutters are notorious for collecting leaves and other debris, such as twigs, balls, roof shingles or pieces thereof, snow, etc., which flow along the rain gutter and into the leader or downspout clogging the leader whereupon the rain gutter overflows and the overflow rain falls down over the side of the rain gutter washing away soil from adjacent the house and frequently washing away soil from plants or other shrubs adjacent the house.

As is further known to those skilled in the art, the rain gutter and leader art is replete with various structures to be added to the typical prior art rain gutter, typically open at the top, for preventing such leaves and other debris from collecting in the rain gutter and clogging the leader; such other structures being typified by screen or other mesh material for being placed over the top of the open rain gutter to prevent the entrance of leaves and other debris. However, since such screen or mesh material is placed on the top of the open prior art rain gutter, leaves, or at least particles thereof, and other debris do enter the openings in the screen and mesh material and, in time, can cause leader clogging and prevention of rain flow through the leader or downspout.

Another problem associated with such prior art screen or mesh material is that it has sharp edges which can puncture and cut the hands of the person installing the screen or mesh material and, such mesh and screens are often damaged when removed for rain gutter cleaning and replacement. Further, upon the rain gutter being clogged underneath such installed screen and mesh material, it is extremely difficult, aggravating and annoying, to have to frequently remove the screen or other mesh material, clean the leaves and other debris out of the rain gutter, and then replace the screen or other mesh material.

Strainers and screening are known to the prior art for being inserted into the entrance of a leader for preventing leaves and other debris from entering and clogging the leader; however, such prior art leader filters typically generally are not successful as the openings thereof are generally too large to prevent passage of the leaves and other debris or are too small thereby causing clogging of the leader filter itself. Such strainers and screening have proven to be ineffective and often these devices catch and hold leaves and other noted debris which necessitates the homeowner climbing a ladder in order to clean these devices.

Without some means or device to prevent leaves and other noted debris from entering the leader or downspout, clumps of leaves and twigs, for example, can enter and block the leader resulting in overflowing rain gutters and, sometimes, these clumps of leaves and other noted debris enter and clog the leader which necessitates removal of the leader from the house in order to be unclogged. Clogged leaders also have been known to split at the seams from pressure of trapped water which turns into expanding ice in freezing weather.

Accordingly, there exists a need in the art for an improved leader filter which, upon being installed, and as compared to the typical prior art leader filter, requires virtually no further maintenance, or at the very most limited further maintenance, and which virtually eliminates the need for constant cleaning and unclogging of the leader and which provides substantially uninterrupted and unclogged flow therethrough of rain from the rain gutter into the leader.

Accordingly, it is the object of the present invention to overcome the above-noted prior art problem and to achieve the above-stated need.

SUMMARY OF THE INVENTION

The new and improved leader filter of the present invention is for being mounted at the top of a leader extending down the side of a building and below the discharge opening formed in the bottom of a rain gutter attached to the building adjacent the roof upon which rain falls. The generally closed hollow leader filter includes a top, front, back, two sides and a bottom, the sides being provided with a plurality of longitudinally extending, generally horizontally disposed rows of interrupted slots, the interruptions between slots in each row being displaced horizontally with respect to the interruptions between slots of the next adjacent row of slots such that there is no generally vertical path of rain flow down the sides which is not interrupted by at least one of the slots, the slots being of a predetermined size sufficiently small to generally prevent the entrance thereinto and into the closed hollow leader filter of leaves and other debris, the top is for receiving rain from the rain gutter discharge opening and for diverting the rain down the sides and the slots are for receiving the rain flowing across the sides and for diverting the rain into the hollow leader filter means, and the bottom is provided with a discharge opening for communicating with the leader and through which discharge opening rain flows from the leader filter into the leader.

DESCRIPTION OF THE PREFERRED EMBODIMENTS

Figure 1:
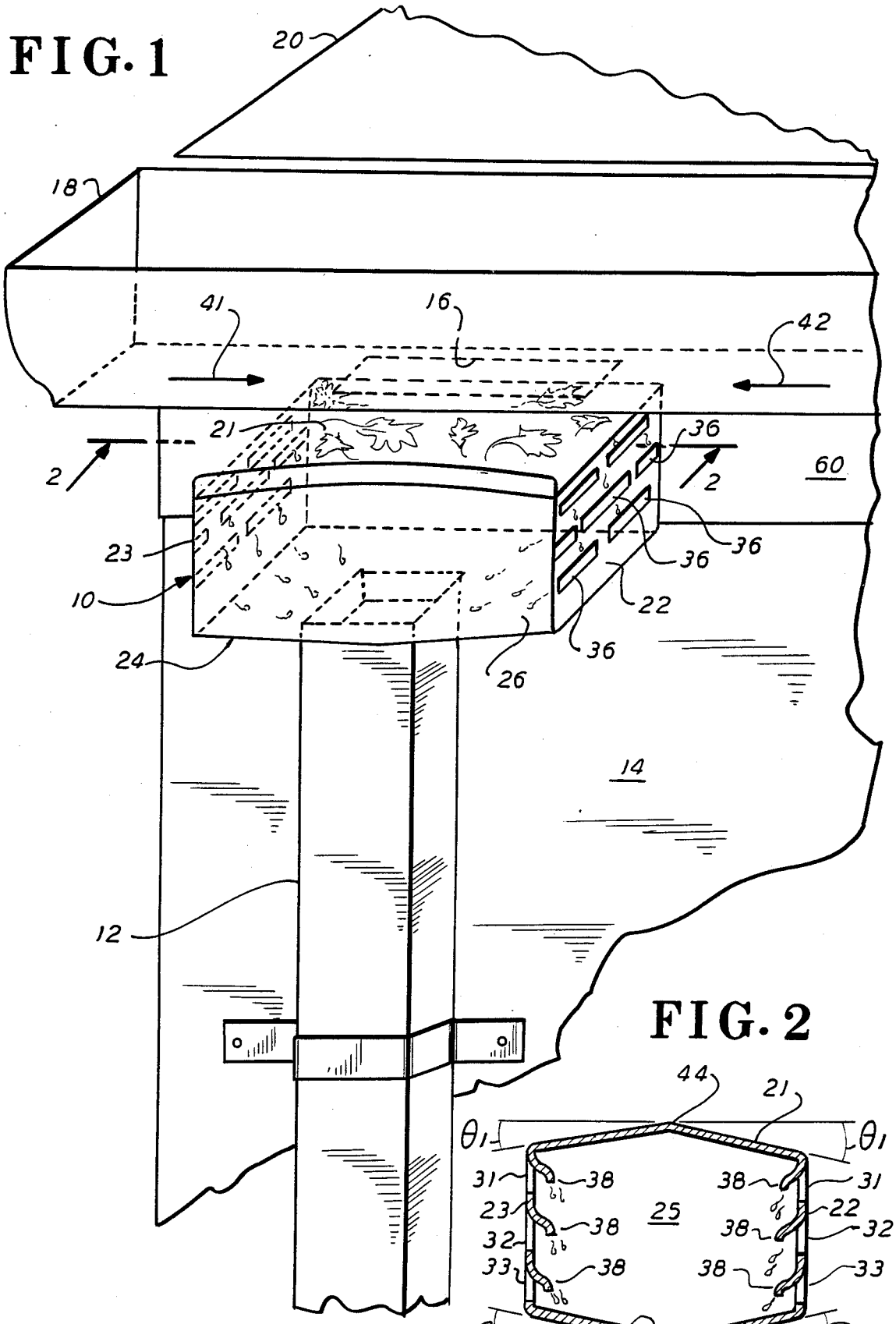
FIG. 1 is a diagrammatic view, in perspective, of a house provided with a rain gutter and a leader filter embodying the present invention.

Referring now to FIG. 1, there is shown a leader filter embodying the present invention and indicated by general numerical designation 10. Generally, the leader filter 10 is for being mounted at the top of a leader 12 extending down the side of a house or other building 14 and below (e.g. approximately 3 inches below) the discharge opening 16 formed in the bottom of a rain gutter 18 attached to the building or house 14 adjacent the edge of a roof 20 upon which rain falls. Generally, it will be understood that the leader filter 10 is for preventing entrance thereinto of leaves and other debris which can cause leader clogging and the stoppage of rain flow from the rain gutter 18 and into and through the leader 12.

Figure 2:
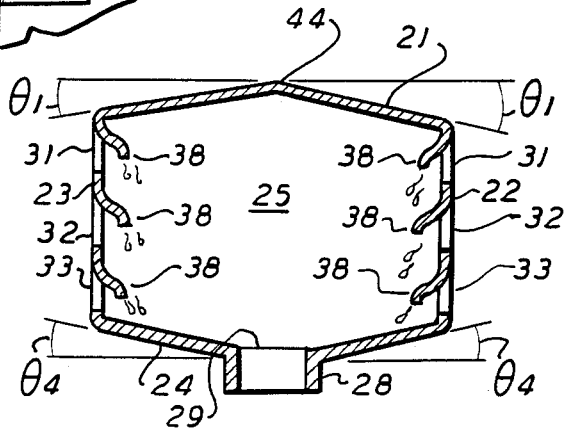
FIG. 2 is a cross-sectional view taken along the line 2—2 in FIG. 1 and in the direction of the arrows.

As may be understood from both FIG. 1 and FIG. 2, the leader filter includes a top 21, two sides 22 and 23, a bottom 24, a back 25 and a front 26.

In addition, leader filter 10 may have its bottom 24 provided with a generally centrally formed, downwardly extending tubular member or portion 28, generally complementary in shape (e.g. cross-sectional shape) to the leader 12 and for telescopically engaging the top of the leader 12 by either being inserted inside thereof or over the outside thereof. The bottom 24 is provided with a discharge opening 29 for discharging rain internally of the filter 10 into the leader 12; in the embodiment of FIG. 2 the discharge opening 29 opens into the top of the tubular member 28.

As is also shown in FIGS. 1 and 2, the sides 22–23 may be provided with a plurality of longitudinally extending, generally horizontally disposed rows 31, 32 and 33 of interrupted slots 36, the interruptions between the slots 36 (FIG. 1) in each row, as may be noted, are displaced horizontally with respect to the interruption between the slots in the next adjacent row of slots such that there is no generally vertical path of rain flow down the sides 22–23 of the leader filter 10 which is not interrupted by at least one of the slots 36. Further, as may be best seen in FIG. 2, the sides 22–23 may be provided with a plurality of generally inwardly and downwardly extending fins or louvers 38 provided along the top edges of the slots 36 and for receiving rain flowing down the sides and for diverting the rain into the generally closed hollow leader filter 10. In the embodiment shown in FIGS. 1 and 2, the fins or louvers 38 are formed integrally with the sides 22–23 by stamping or die cutting the fins out of the sides and by bending the fins generally inwardly and downwardly as shown and wherein the slots are formed in the spaces in the sides where the fins or louvers 38 have been pushed inwardly.

Figure 4:
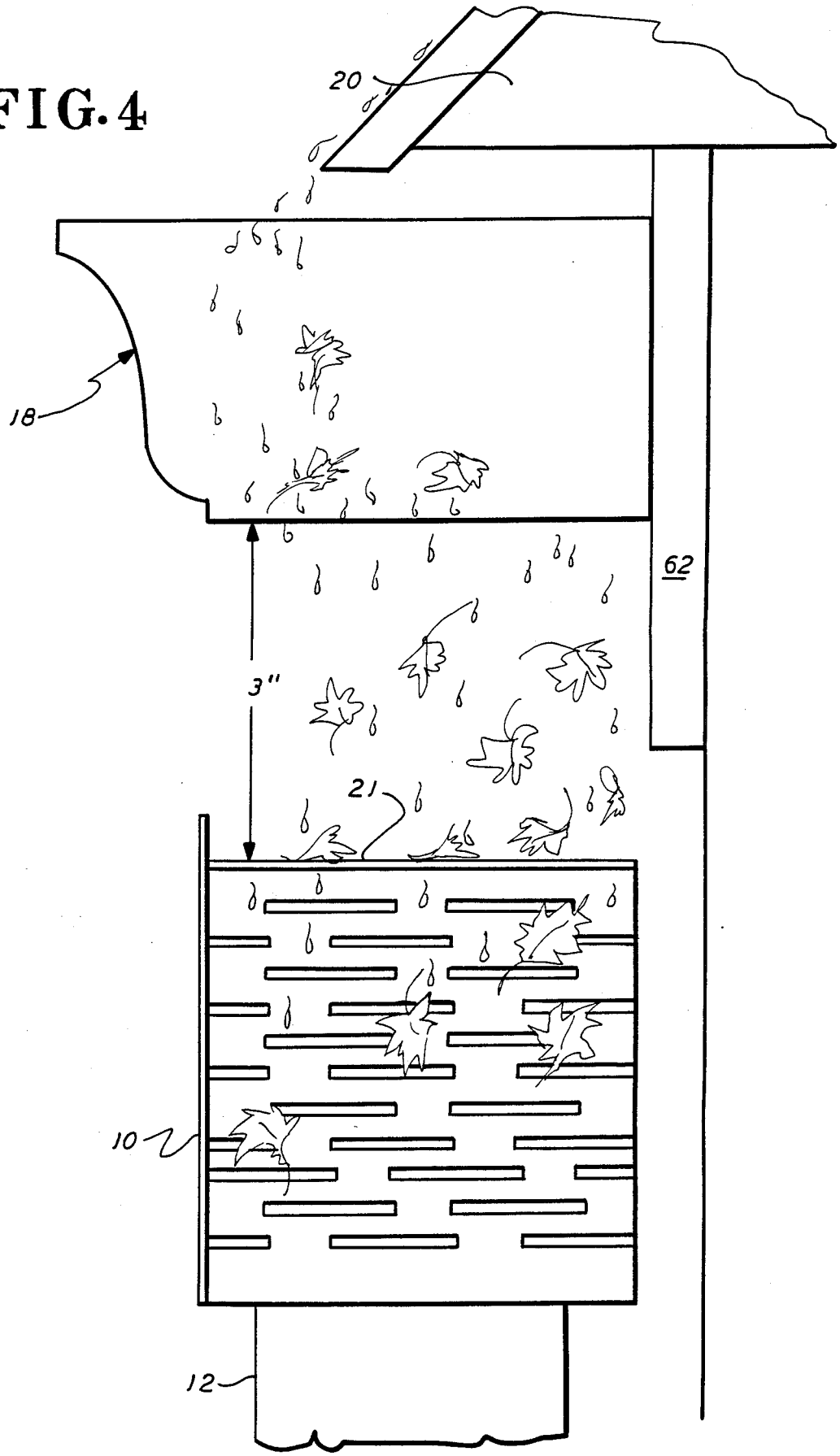
FIG. 4 is a side view in plan illustrating the function of a leader filter embodying the present invention.

For installation and operation, and referring again to FIGS. 1 and 2, the upper portion of the leader 12 is removed and the leader filter 10 is mounted at the top of the leader 12 with the downwardly extending portion 28 (FIG. 2) telescopically engaging the top of the leader and with the leader filter 10 mounted a predetermined distance below the bottom of the rain gutter 18 and below the discharge opening 16 formed in the bottom of the rain gutter 18 (for example the discharge opening 16 may be the opening formed in the rain gutter 18 where the leader 12 was previously attached or inserted). Upon rain, leaves and other debris falling into the rain gutter 18 (FIG. 1) and flowing therealong as indicated by the arrows 41 and 42 into the discharge opening 16 formed in the bottom of the rain gutter 18, the rain, leaves and other debris will fall onto the top 21 of the leader filter 10 and the top 21 will divert the rain, leaves and other debris down the sides 22–23 (FIG. 4) and the rain will be received by and passed through the slots 36 and flow into the interior of the leader filter 10, but the leaves and other debris, due to the above-noted predetermined size of the slots, will not pass within the slots but instead will pass over the faces of the sides 22–23 and fall harmlessly to the ground adjacent the house 14. Upon the slots being provided with the fins or louvers 38, the rain will flow along the fins or louvers 38 and be diverted into the interior of the leader filter 10 as may be noted in FIG. 2.

As may be best seen in FIG. 2, the top 21 of the leader filter 10 may include a mid portion indicated by general numerical designation 44 extending substantially parallel to the sides 22–23 and the top 21 extends downwardly from the mid portion 44 toward the sides 22–23 at an angle $\theta_1$ with respect to the horizontal to facilitate flow of the rain from the top 21 onto the sides 22–23. In a preferred embodiment, $\theta_1$ is substantially 1°–3°.

Figure 3:
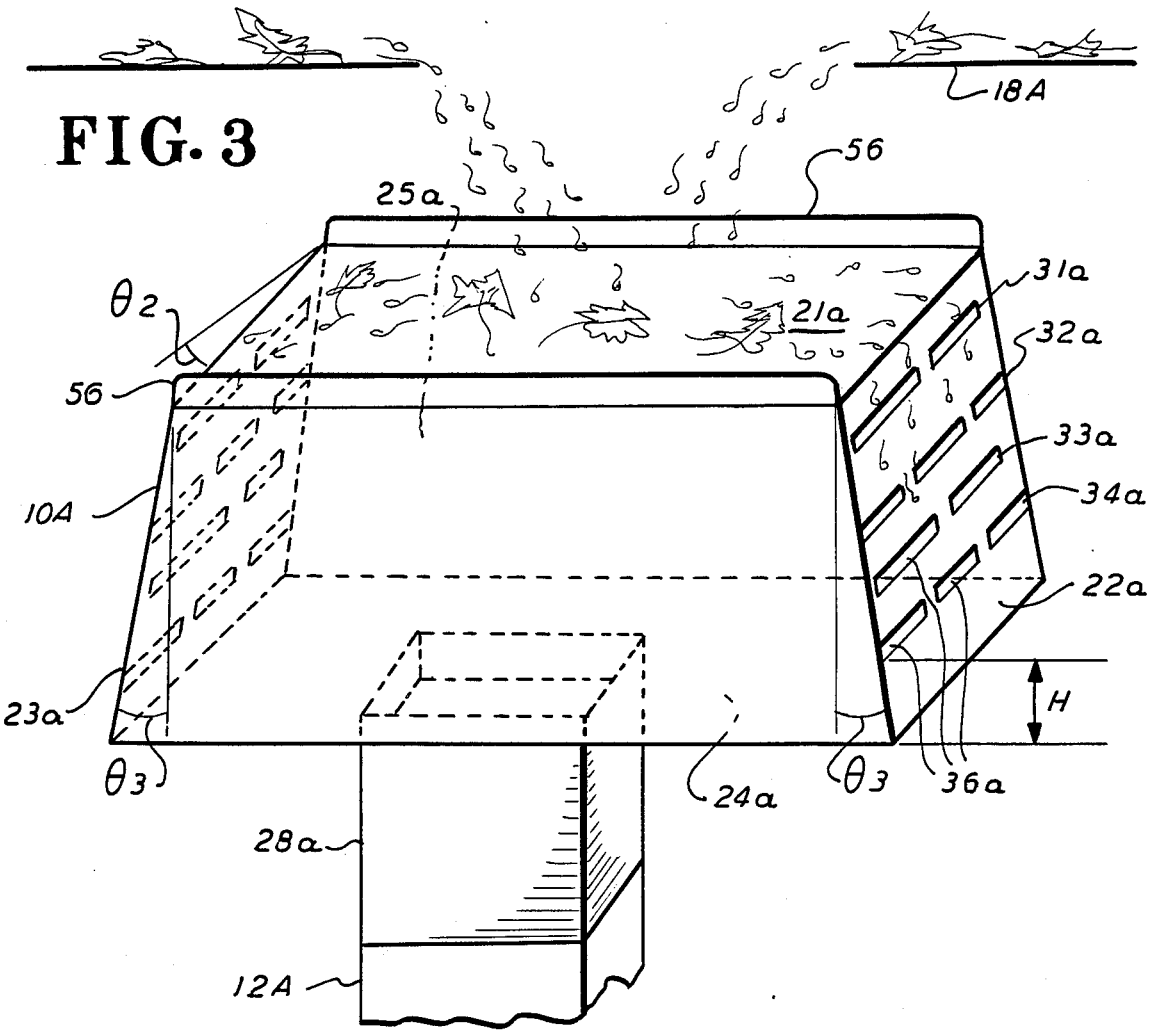
FIG. 3 is a diagrammatic view, in perspective, of an alternate embodiment of a leader filter embodying the present invention.

An alternate embodiment, leader filter 10A, is illustrated in FIG. 3 and this embodiment is substantially the same as leader filter 10 of FIG. 1 but differs in that the top *21a* is inclined downwardly at a predetermined angle $\theta_2$ with respect to the horizontal to facilitate flow of the rain from the top 21 onto the sides 22–23; in the preferred embodiment, angle $\theta_2$ is substantially 1°–3°. Additionally, a difference in leader filter embodiment 10A is that the sides *22a–23a* extend outwardly at a predetermined angle $\theta_3$ with respect to the vertical to facilitate flow of the rain into the slots *36a*; in a preferred embodiment, the angle $\theta_3$ is substantially 1°–3°. By providing a predetermined vertical distance H, FIG. 3, between the bottom rows of the slots 36 and the bottom *24a* of the leader filter *10a*, a trough may be provided internally of the leader filter *10a* through which the rain can flow to the leader filter discharge opening and into the leader 12 without overflowing outwardly through the slots *36a*.

Figure 5:
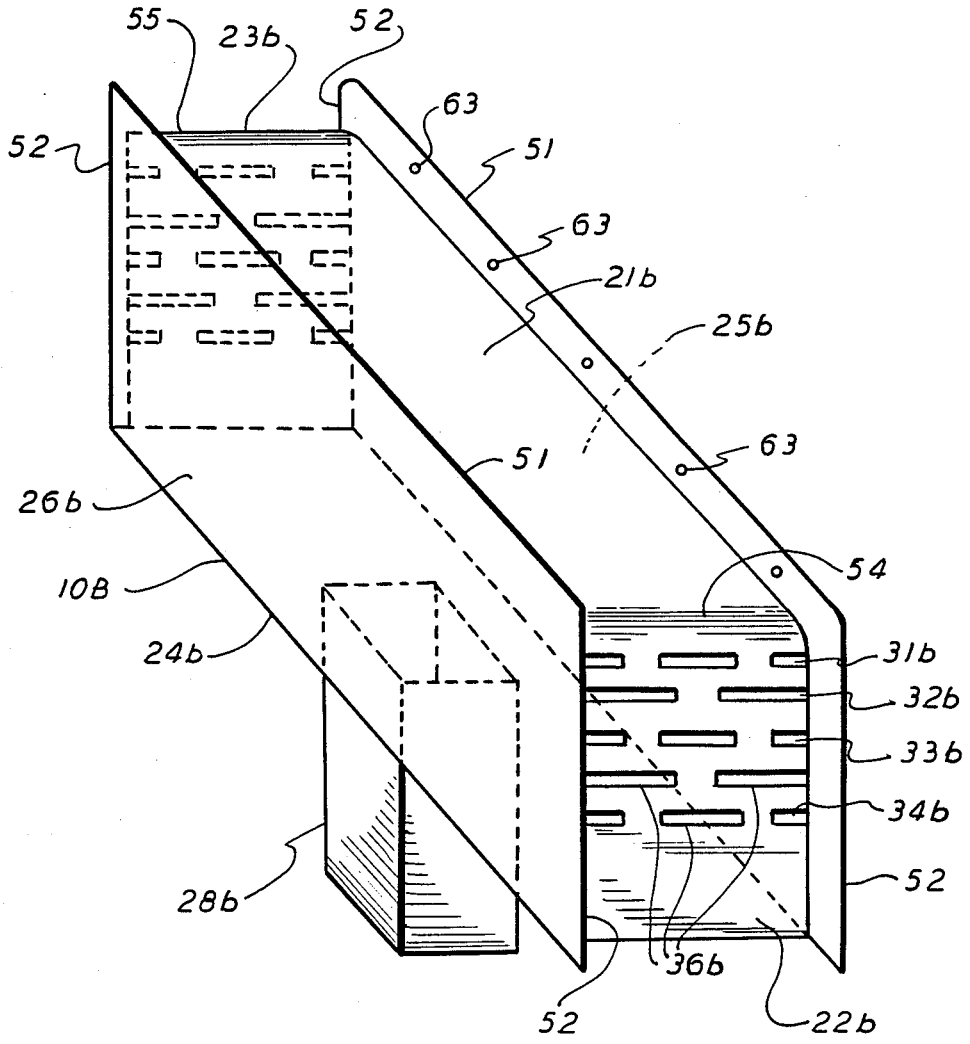
FIG. 5 is a diagrammatic view, in perspective, of a still further alternate embodiment of a leader filter embodying the present invention.

A still further alternate embodiment, leader filter 10B, is illustrated in FIG. 5 and which leader filter is substantially the same as leader filter 10 of FIG. 1 except that the front and back *26b* and *25b* may be provided with top portions 51—51 extending vertically above the top *21b* and with side portions 52—52 extending outwardly beyond the sides *22b–23b* to facilitate flow of the rain from the top *21b* onto the sides *22b–23b*. In addition, the top *21b* and sides *22b–23b*, as shown in FIG. 5, merge into outwardly rounded edges 54 and 55 which facilitate flow of the rain from the top *21b* onto the sides *22b–23b*. As shown in FIG. 3, the front *26a* and back *25b* may be provided with upwardly extending portions 56—56 which, both alone and in combination with the downwardly inclined top *21a*, facilitate flow of the rain from the top *21a* onto the sides *22a–23a*.

Referring again generally to the various embodiments of the leader filter of the present invention, it will be understood that the leader filter, particularly the downwardly extending tubular portions 28 . . . *28b*, may be secured to the bottom of the leader filters 10 . . . 10C by being suitably secured thereto, depending upon the materials of which the leader filter and leader are made, by metal tapping screws, and the like. In addition, the various embodiments of the leader filter may be suitably dimensioned so as to extend against the facia board (e.g. facia board 60 in FIG. 1 and facia board 62 in FIG. 4) whereupon the back of the leader filter, and hence the leader filter itself, may be suitably fastened to the fascia board by suitable metal screws extending through the holes, e.g. holes 63, formed in the upper portion 51 of the back *25b* as shown in FIG. 5. Also, it will be understood, that depending upon the material compatibility of the various embodiments of the leader filter of the present invention with the materials of various leaders known to the art, the leader filters of the present invention may be made of aluminum, PVC, fiberglass, or the like.

As to the manufacture of the various embodiments of the leader filters according to the present invention, it will be understood by those skilled in the art that the top, bottom, front, back and sides of the leader filters may be made from separate pieces of material, suitably shaped and joined in various manners known to those skilled in the art.

The top, bottom, sides, front and back of the leader filter may be suitably dimensioned to be compatible or functional with the dimensions of rain gutters and leaders or downspouts known to the art; in various embodiments of the leader filters of the present invention the front, back and sides are approximately 4½ inches high, the front and back approximately 9 inches wide, and the sides approximately 3 inches wide or deep.

Figure 6:
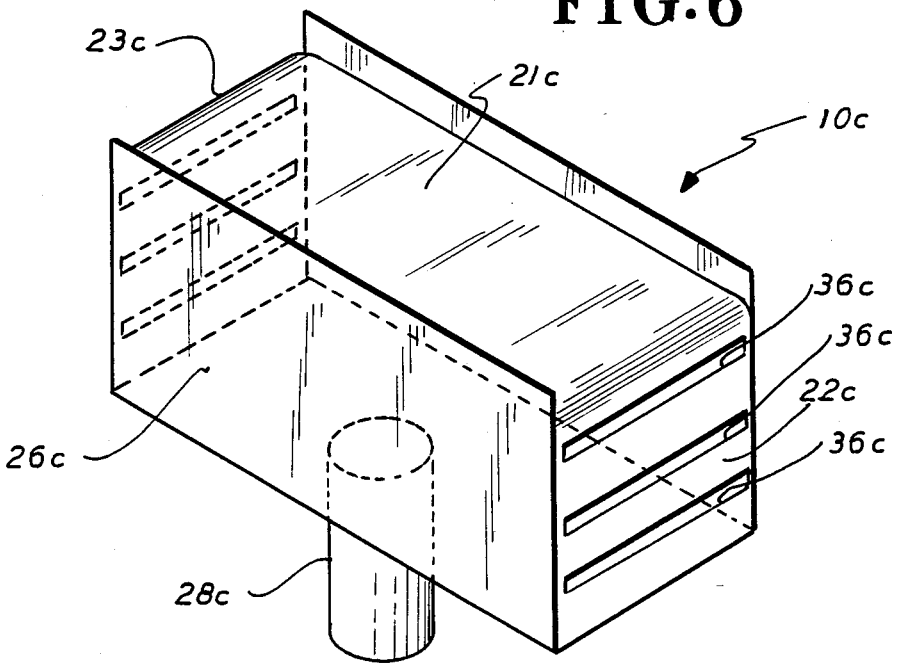
FIG. 6 is a diagrammatic view, in perspective, of a further alternate embodiment of a leader filter embodying the present invention.

Referring now to FIG. 6, there is shown a further alternate embodiment of the leader filter embodying the present invention and indicated by general numerical designation 10C. Leader filter 10C is substantially the same as the earlier described embodiments except that the sides 22C and 23C are provided with a plurality of longitudinally extending, generally horizontally disposed rows of slots which extend across the entire width of the sides.

It will be further noted, and as shown in FIG. 2, the leader filter of the present invention may be provided with a bottom, such as bottom 24 which, like the top 21, is provided with a mid-portion extending substantially parallel to the sides 22 and 23 and which bottom 24 extends upwardly from the mid-portion toward the sides 22–23 at an angle $\theta_4$ with respect to the horizontal to facilitate flow of the rain from the bottom 24 into the tubular portion 28 and into the leader 12.

It will be understood by those skilled in the art that many modifications and variations of the present invention may be made without departing from the spirit and the scope thereof.

What is claimed is:

1. Leader filter for being mounted at the top of a leader extending down the side of a building and below the discharge opening formed in the bottom of a rain gutter attached to the building adjacent the edge of a roof upon which rain falls, said leader filter for preventing entrance thereinto of leaves and other debris which cause leader clogging and the stoppage of rain flow through the leader, comprising:

generally closed hollow leader filter means including a top, two sides and a bottom;

said sides provided with a plurality of longitudinally extending, generally horizontally disposed rows of slots such that there is no generally vertical path of rain flow down said sides which is not interrupted by at least one of said slots, said slots of a predetermined size sufficiently small to generally prevent the entrance thereinto and into said generally closed hollow leader filter means of said leaves and other debris;

said top for receiving rain from said rain gutter discharge opening and for diverting said rain down said sides and said slots for receiving rain flowing across said sides and for diverting said rain into said hollow leader filter means; and said bottom provided with a discharge opening for communicating with said leader and through which discharge opening rain flows from said leader filter into said leader.

2. Leader filter according to claim 1 wherein said plurality of longitudinally extending, generally horizontally disposed rows of slots are a plurality of longitudinally extending, generally horizontally disposed rows of interrupted slots, wherein the interruptions between the slots in each row are displaced horizontally with respect to the interruptions between the slots in the next adjacent row of slots.

3. Leader filter according to claim 1 wherein said plurality of longitudinally extending, generally horizontally disposed rows of slots are a plurality of longitudinally extending, generally horizontally disposed rows of slots extending across the entire width of said sides.

4. Leader filter according to claim 1 wherein said top and sides merge into outwardly rounded edges which facilitate flow of said rain from said top onto said sides.

5. Leader filter according to claim 1 wherein said generally closed hollow leader filter means further include a front having a top portion extending upwardly above said top and for preventing flow of said rain from said top down said front and for cooperating with said top to divert said rain onto said sides.

6. Leader filter according to claim 5 wherein said top is inclined at a predetermined angle downwardly from the horizontal to enhance the flow of said rain from said top onto said sides.

7. Leader filter according to claim 6 wherein said predetermined angle is substantially 1°–3°.

8. Leader filter according to claim 1 wherein said top includes a mid portion extending substantially parallel to said sides and said top extending downwardly from said mid-portion toward said sides at a predetermined angle with respect to the horizontal to facilitate flow of said rain from said top onto said sides.

9. Leader filter according to claim 8 wherein said predetermined angle is substantially 1°–3°.

10. Leader filter according to claim 1 wherein said generally closed hollow leader filter means further includes a front and a back, said front and said back each including a top portion extending vertically above said top and side portions extending outwardly beyond said sides to facilitate flow of said rain from said top onto said sides.

11. Leader filter according to claim 1 wherein there is a predetermined vertical distance between the bottom rows of said interrupted slots and said bottom, said predetermined vertical distance providing a trough internally of said leader filter through which said rain can flow to said leader filter discharge opening and into said leader without overflowing outwardly through said slots.

12. Leader filter according to claim 11 wherein said predetermined vertical distance is substantially 2 inches.

13. Leader filter according to claim 1 wherein said sides are provided with a plurality of generally inwardly and downwardly extending fins, said fins provided along the top edges of said slots, and for receiving rain flowing down said sides and for diverting said rain into said generally closed hollow leader filter.

14. Leader filter according to claim 13 wherein said fins are formed integrally with said sides by stamping or die cutting said fins out of said sides and by bending said fins generally inwardly and downwardly, and wherein said slots are formed in the spaces in said sides where said fins have been pushed inwardly.

15. Leader filter according to claim 1 wherein said bottom is provided with a generally centrally formed, downwardly extending tubular portion, generally complementary in shape to said leader, and for telescopically engaging the top of said leader.

16. Leader filter according to claim 1 wherein said sides are inclined at a predetermined angle outwardly with respect to the vertical to facilitate flow of the rain into the slots.

17. Leader filter according to claim 16 wherein said predetermined angle is substantially 1°-3°.

18. Leader filter according to claim 1 wherein said bottom includes a mid-portion extending substantially parallel to said sides and said bottom extending upwardly from said mid-portion toward said sides at a predetermined angle with respect to the horizontal to facilitate flow of said rain from said leader filter into said leader.

19. Leader filter according to claim 18 wherein said predetermined angle is substantially 1°-3°.

* * * * *